US009318809B2

(12) United States Patent
Takahashi et al.

(10) Patent No.: US 9,318,809 B2
(45) Date of Patent: Apr. 19, 2016

(54) RADIO WAVE ABSORBER

(71) Applicant: Kabushiki Kaisha Toshiba, Minato-ku (JP)

(72) Inventors: Toshihide Takahashi, Yokohama (JP); Tomohiro Suetsuna, Kawasaki (JP); Koichi Harada, Bunkyo (JP); Tomoko Eguchi, Chuo (JP); Seiichi Suenaga, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 74 days.

(21) Appl. No.: 14/480,759

(22) Filed: Sep. 9, 2014

(65) Prior Publication Data

US 2015/0303583 A1 Oct. 22, 2015

(30) Foreign Application Priority Data

Sep. 20, 2013 (JP) ..... 2013-194768

(51) Int. Cl.
*H01Q 17/00* (2006.01)

(52) U.S. Cl.
CPC ..... *H01Q 17/004* (2013.01); *H01Q 17/00* (2013.01); *H01Q 17/008* (2013.01)

(58) Field of Classification Search
CPC ..... H01Q 17/00–17/008
USPC ..... 342/1–4
See application file for complete search history.

(56) References Cited

U.S. PATENT DOCUMENTS 5,389,434 A * 2/1995 Chamberlain ..... H01Q 17/004 342/1
5,833,770 A * 11/1998 Ominato ..... C23C 14/185 148/305
7,740,939 B2 * 6/2010 Harada ..... B22F 1/02 264/603
8,289,222 B2 * 10/2012 Suetsuna ..... H01F 1/33 343/787
8,305,281 B2 * 11/2012 Suetsuna ..... H01F 1/33 343/787
8,703,282 B2 * 4/2014 Suetsuna ..... B22F 1/02 428/216
8,840,800 B2 * 9/2014 Suetsuna ..... C22C 29/12 252/62.55
8,986,839 B2 * 3/2015 Yonetsu ..... B22F 1/0018 427/212
8,988,301 B2 * 3/2015 Yonetsu ..... B22F 1/0062 343/787
9,225,072 B2 * 12/2015 Takahashi ..... H01Q 17/004
2008/0220231 A1 * 9/2008 Suetsuna ..... B82Y 25/00 428/216
2009/0242826 A1 * 10/2009 Harada ..... B22F 1/0018 252/62.55
2010/0060538 A1 * 3/2010 Suetsuna ..... H01F 1/33 343/787
2010/0060539 A1 * 3/2010 Suetsuna ..... H01F 1/33 343/787
2012/0038532 A1 * 2/2012 Yonetsu ..... B22F 1/0062 343/787
2012/0049100 A1 * 3/2012 Yonetsu ..... B22F 1/0018 252/62.54

(Continued)

FOREIGN PATENT DOCUMENTS

JP 10-56292 2/1998
JP 2001-358493 12/2001

(Continued)

*Primary Examiner* — Peter Bythrow
(74) *Attorney, Agent, or Firm* — Oblon, McClelland, Maier & Neustadt, L.L.P.

(57) ABSTRACT

A radio wave absorber according to an embodiment includes a plurality of metal particles including at least one kind of magnetic metal element selected from a first group of Fe, Co, and Ni. Each of the plurality of metal particles has a linear expansion coefficient of $1\times10^{-6}$/K or more and $10\times10^{-6}$/K or less. The radio wave absorber also includes a binding layer binding the metal particles and having higher resistance than the metal particle, wherein a volume filling ratio of the metal particles in the radio wave absorber is 10% or more and 50% or less.

12 Claims, 6 Drawing Sheets

(56) References Cited

U.S. PATENT DOCUMENTS

| | | | | |
|---|---|---|---|---|
| 2013/0257639 | A1* | 10/2013 | Takahashi | H01Q 17/00 342/1 |
| 2015/0084804 | A1* | 3/2015 | Takahashi | H01Q 17/004 342/1 |

FOREIGN PATENT DOCUMENTS

| | | |
|---|---|---|
| JP | 2003-298279 | 10/2003 |
| JP | 2004-172226 | 6/2004 |
| JP | 2004-186371 | 7/2004 |
| JP | 2010-87462 | 4/2010 |

* cited by examiner

RADIO WAVE ABSORBER

CROSS-REFERENCE TO RELATED APPLICATION

This application is based upon and claims the benefit of priority from Japanese Patent Application No. 2013-194768, filed on Sep. 20, 2013, the entire contents of which are incorporated herein by reference.

FIELD

Embodiments described herein relate generally to a radio wave absorber.

BACKGROUND

A radio wave absorber of a magnetic loss type formed of a magnetic material generally has the radio wave absorbing characteristic of a wider frequency range than a radio wave absorber of a dielectric loss type or a conduction loss type. However, the radio wave absorber of the magnetic loss type with excellent characteristics in the range of 8 to 18 GHz (X band, Ku band) has not been realized yet.

In the radio wave absorber used in the wide temperature range, it is expected that the change in radio wave absorbing characteristic due to the temperature change is suppressed.

DETAILED DESCRIPTION

A radio wave absorber according to an embodiment includes: a plurality of metal particles including at least one kind of magnetic metal element selected from a first group of Fe, Co, and Ni, each of the plurality of metal particles having a linear expansion coefficient of $1\times10^{-6}$/K or more and $10\times10^{-6}$/K or less; and a binding layer binding the metal particles and having higher resistance than the metal particle, wherein a volume filling ratio of the metal particles in the radio wave absorber is 10% or more and 50% or less.

An embodiment of the present disclosure is hereinafter described with reference to the drawings.

A radio wave absorber according to the present embodiment includes: a plurality of metal particles including at least one kind of magnetic metal element selected from a first group of Fe, Co, and Ni, each of the plurality of metal particles having a linear expansion coefficient of $1\times10^{-6}$/K or more and $10\times10^{-6}$/K or less; and a binding layer binding the metal particles and having higher resistance than the metal particle, wherein a volume filling ratio of the metal particles in the radio wave absorber is 10% or more and 50% or less.

By having the above structure, the radio wave absorber according to the embodiment can suppress the temperature dependence of the dielectric constant; thus, the temperature dependence of the radio wave absorbing characteristic can be suppressed.

Figure 1A:
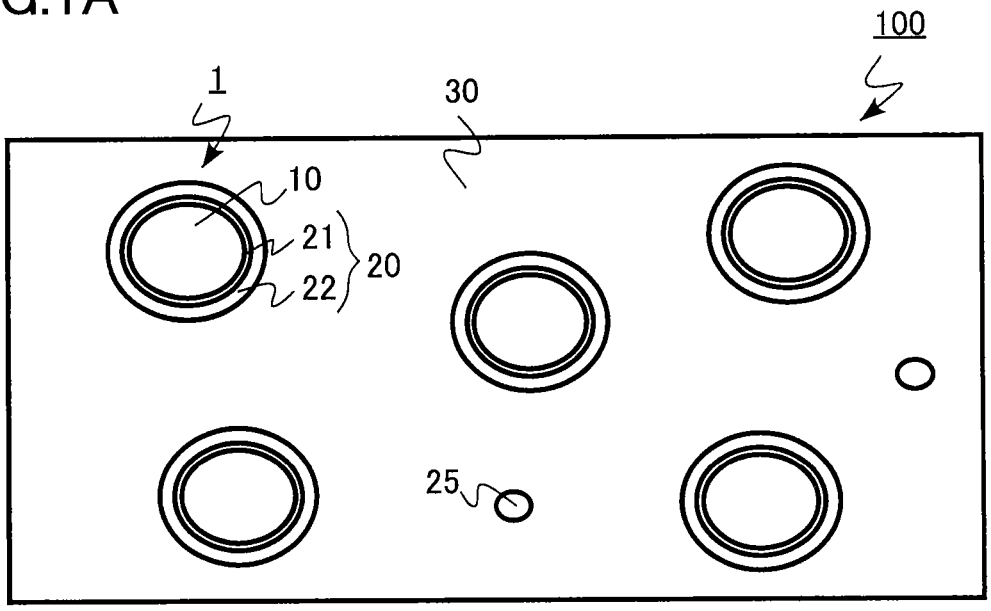
FIGS. 1A and 1B are schematic sectional views of a radio wave absorber according to an embodiment.
Figure 1B:
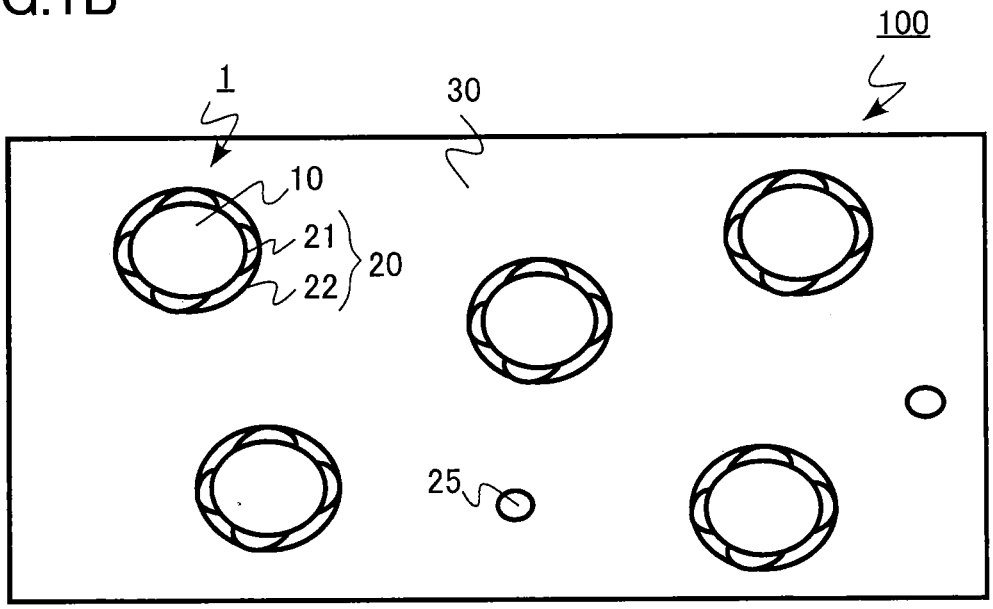

FIGS. 1A and 1B are schematic sectional views of the radio wave absorber according to the embodiment. A metal particle in this embodiment is a core-shell type particle. Each of FIG. 1A and FIG. 1B illustrates the radio wave absorber in which a shell layer of the core-shell type particle is different.

A radio wave absorber 100 includes a plurality of core-shell type particles 1 and a binding layer 30 binding the core-shell type particles 1. The binding layer 30 has higher resistance than the core-shell type particle 1 and is formed of, for example, resin.

The core-shell type particle 1 includes a core portion 10 and a shell layer 20 that coats at least a part of the core portion 10. The core portion 10 includes at least one kind of magnetic metal element selected from a first group consisting of Fe (iron), Co (cobalt), and Ni (nickel). The core portion 10 further includes at least one kind of metal element selected from a second group consisting of Mg (magnesium), Al (aluminum), Si (silicon), Ca (calcium), Zr (zirconium), Ti (titanium), Hf (hafnium), Zn (zinc), Mn (manganese), a rare-earth element, Ba (barium), and Sr (strontium).

The shell layer 20 includes an oxide layer 21 and a carbon-contained material layer 22. The oxide layer 21 includes at least one kind of metal element selected from the second group that is included in the core portion 10. In the case of FIG. 1A, the oxide layer 21 is provided to coat the core portion 10 and the carbon-contained material layer 22 is provided to coat the oxide layer 21. In the case of FIG. 1B, the shell layer 20 coating the core portion 10 is a mixed layer of the oxide layer 21 and the carbon-contained material layer 22.

The shape of the core-shell type particle 1 is not limited thereto and may be variously changed. If the oxide layer 21 is formed so that the contact between the core portions 10 is avoided, a part of the carbon-contained material layer 22 can be omitted.

The core-shell type particle 1 has a linear expansion coefficient of $1\times10^{-6}$/K or more and $10\times10^{-6}$/K or less. It is preferable that this range of the linear expansion coefficient is satisfied at a temperature of least at 25° C. (approximately room temperature). The linear expansion coefficient is desirably $8\times10^{-6}$/K or less, and more desirably $6\times10^{-6}$/K or less.

When the linear expansion coefficient of the core-shell type particle 1 is greater than the above range, the temperature dependence of the dielectric constant may become too high, in which case the temperature dependence of the radio wave absorbing characteristic becomes excessively high. Moreover, it is difficult to achieve the core-shell type particle 1 with the linear expansion coefficient less than the above range.

In this specification, the linear expansion coefficient of the core-shell type particle 1 is represented by the linear expansion coefficient of the metal of the core portion of the core-shell type particle 1. The linear expansion coefficient of the metal is measured using a thermomechanical analyzer and an optical scanning measurement apparatus based on JISZ2285: "measuring method of coefficient of linear thermal expansion of metallic materials." For example, the linear expansion coefficient of a cylindrical test piece with a length of 10 mm and a diameter of 5 mm in the temperature range of 25° C.±100° C. can be measured using the laser dilatometer manufactured by LINSEIS in Germany.

The core-shell type particle 1 shows ferromagnetic property by the magnetic metal element included in the core portion 10. The core portion 10 is, for example, the FeNi alloy or the FeNiCo alloy. The core portion 10 is, for example, the invar alloy, the 42Alloy, or Kovar® alloy.

The radio wave absorber 100 may include an oxide particle 25 in addition to the core-shell type particle 1. This oxide particle 25 is formed by, for example, the separation of the oxide layer 21 from the core-shell type particle 1. The oxide particle 25 includes an element belonging to the second group that is common to the core portion 10 and the oxide layer 21. The oxide particle 25 is, for example, included in the binding layer 30.

It is preferable that the oxide particle 25 contains a larger proportion of the metal element of the second group relative to the magnetic metal of the first group than the oxide layer 21. In other words, it is desirable that the ratio of the number of the atoms of the element belonging to the second group to the number of the atoms of the element belonging to the first group in the oxide particle 25 is higher than the ratio of the number of the atoms of the element belonging to the second group to the number of the atoms of the element belonging to the first group in the oxide layer 21. This is because the oxidation resistance of the metal particle is improved.

If the oxide layer 21 is not separated from the core-shell type particle 1, the radio wave absorber 100 may not include the oxide particle 25. When the oxide particle 25 is present, the thermal stability of the radio wave absorber 100 is improved.

The volume filling ratio of the core-shell type particle 1 in the radio wave absorber is 10% or more and 50% or less. The volume filling ratio is desirably 15% or more and 30% or less.

When the volume filling ratio is greater than the above range, the metallic property is appeared, and thus the reflectance is increased and the radio wave absorbing characteristic is deteriorated. Further, the temperature dependence of the radio wave absorbing characteristic is increased. On the other hand, when the ratio is less than the above range, the saturation magnetization may deteriorate and the radio wave absorbing characteristic due to the magnetic characteristic may deteriorate accordingly. Moreover, the thickness necessary for achieving the practical radio wave absorbing characteristic may become too large.

The volume filling ratio of the core-shell type particle 1 (metal particle) can be calculated by, for example, processing an image of a TEM (Transmission Electron Microscope) photograph and obtaining the ratio between the sectional area of the individual metal particle and the area of the other components. It is noted that in the case of the core-shell type particle (metal particle) 1, the volume of the shell layer 20 is not included in the volume of the metal particle and the volume of just the core portion 10 is regarded as the volume of the metal particle (core-shell type particle 1).

Figure 2:
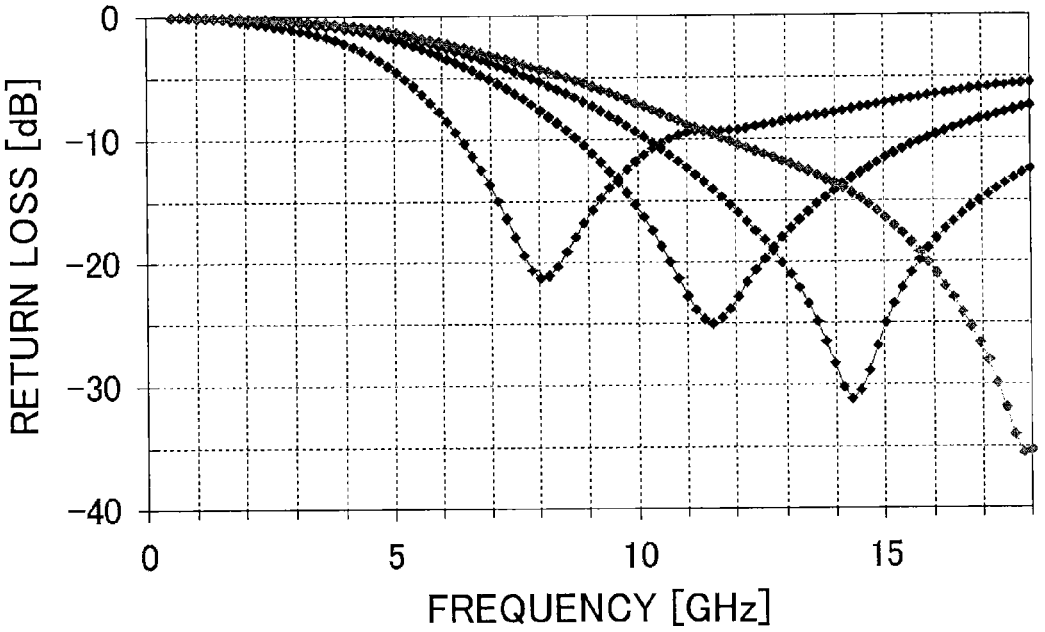
FIG. 2 is a diagram illustrating the radio wave absorbing characteristic of the radio wave absorber according to the embodiment.

FIG. 2 is a diagram illustrating the radio wave absorbing characteristic of the radio wave absorber of this embodiment. The horizontal axis represents the frequency of the radio wave and the vertical axis represents the return loss. The radio wave absorber of this embodiment indicates the excellent radio wave absorbing characteristic in the band ranging from 8 to 18 GHz (X band, Ku band). By changing the volume filling ratio of the metal particle between 20 and 30% and the thickness of the sample between 1 and 2 mm, the radio wave absorbing band can be changed.

Figure 3A:
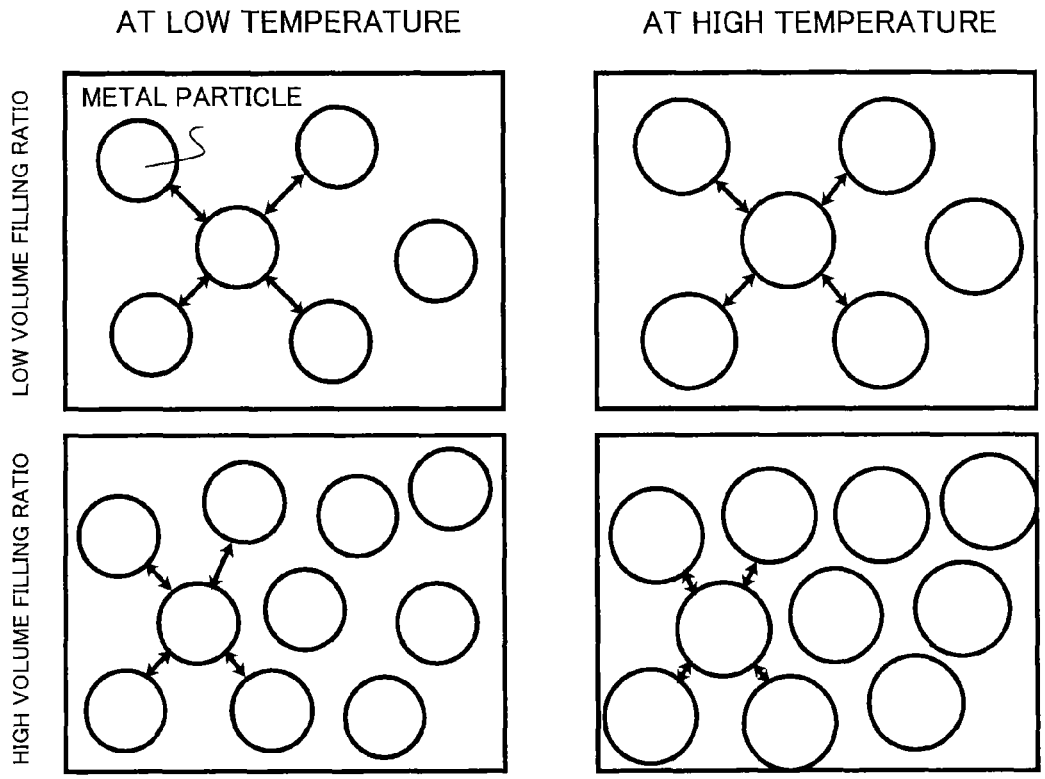
FIGS. 3A and 3B are diagrams for describing the operation of the embodiment.
Figure 3B:
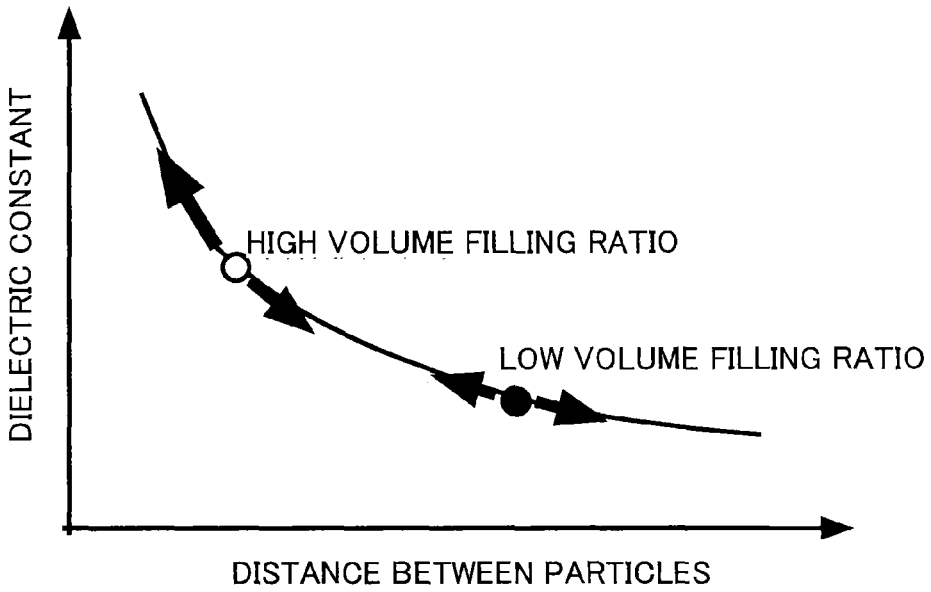

FIGS. 3A and 3B are diagrams for describing the operation of this embodiment. FIG. 3A is an explanatory view of the relation among the volume filling ratio of the metal particle, the temperature, and the distance between the metal particles. FIG. 3B is a diagram expressing the relation between the dielectric constant and the distance between the metal particles.

As illustrated in FIG. 3A, when the temperature is low and when the temperature is high, the distance between the metal particles changes by thermal contraction or expansion of the metal particles. The amount of change of the distance between the metal particles is constant when the volume filling ratio of the metal particles is either low or high. However, the absolute value of the distance between the metal particles is large when the volume filling ratio of the metal particles is low and the absolute value is small when the volume filling ratio of the metal particles is high.

As illustrated in FIG. 3B, the dielectric constant of the radio wave absorber becomes higher as the absolute value of the distance between the metal particles becomes smaller. The dielectric constant of the radio wave absorber changes more sharply as the absolute value of the distance between the metal particles becomes smaller. Therefore, the amount of change of the dielectric constant of the radio wave absorber (black thick arrow in the drawing) is larger when the volume filling ratio of the metal particles is high than when the ratio thereof is low.

Figure 4:
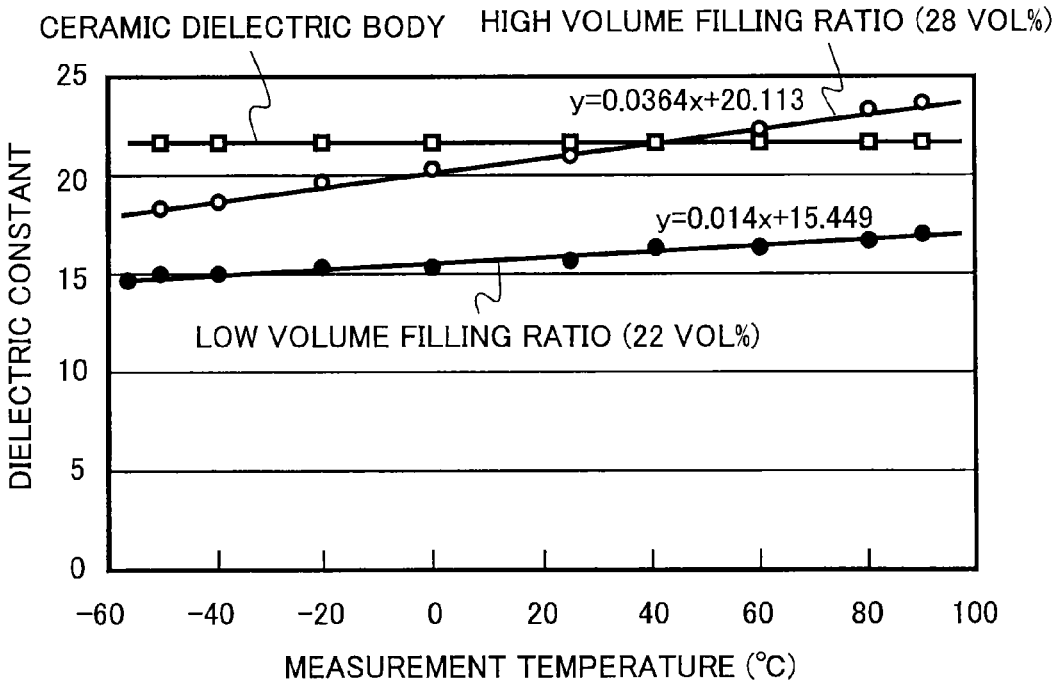
FIG. 4 is a diagram illustrating the temperature dependence of the dielectric constant of the radio wave absorber.

FIG. 4 is a diagram illustrating the temperature dependence of the dielectric constant of the radio wave absorber. FIG. 4 illustrates the dependence in the case where the radio wave absorber including the metal particle and the resin binding layer has a high volume filling ratio (28 vol %) and a low volume filling ratio (22 vol %). Moreover, the evaluation result in the case of the ceramic dielectric body is also shown for comparison. In the case of the high volume filling ratio (28 vol %), the temperature dependence is larger than in the case of the low volume filling ratio (22 vol %)

The radio wave absorbing characteristic of the radio wave absorber is determined by the magnetic permeability and the dielectric constant of the radio wave absorber. Therefore, the radio wave absorbing characteristic varies when the dielectric constant of the radio wave absorber changes. It is necessary to suppress the change of the dielectric constant of the radio wave absorber according to the temperature change in order to suppress the change in radio wave absorbing characteristic.

The change of the dielectric constant depending on the temperature is desirably within ±10% in the temperature range of 25° C. (room temperature)±50° C., and more desirably 25° C. (room temperature)±100° C. To achieve this, the volume filling ratio of the radio wave absorber of this embodiment is set to 50% or less and the linear expansion coefficient of the metal particle is set to $10\times10^{-6}$/K or less. From the viewpoint of suppressing the change of the dielectric constant depending on the temperature, the linear expansion coefficient of the metal particle is desirably $8\times10^{-6}$/K or less, and more desirably $6\times10^{-6}$/K or less.

Figure 5:
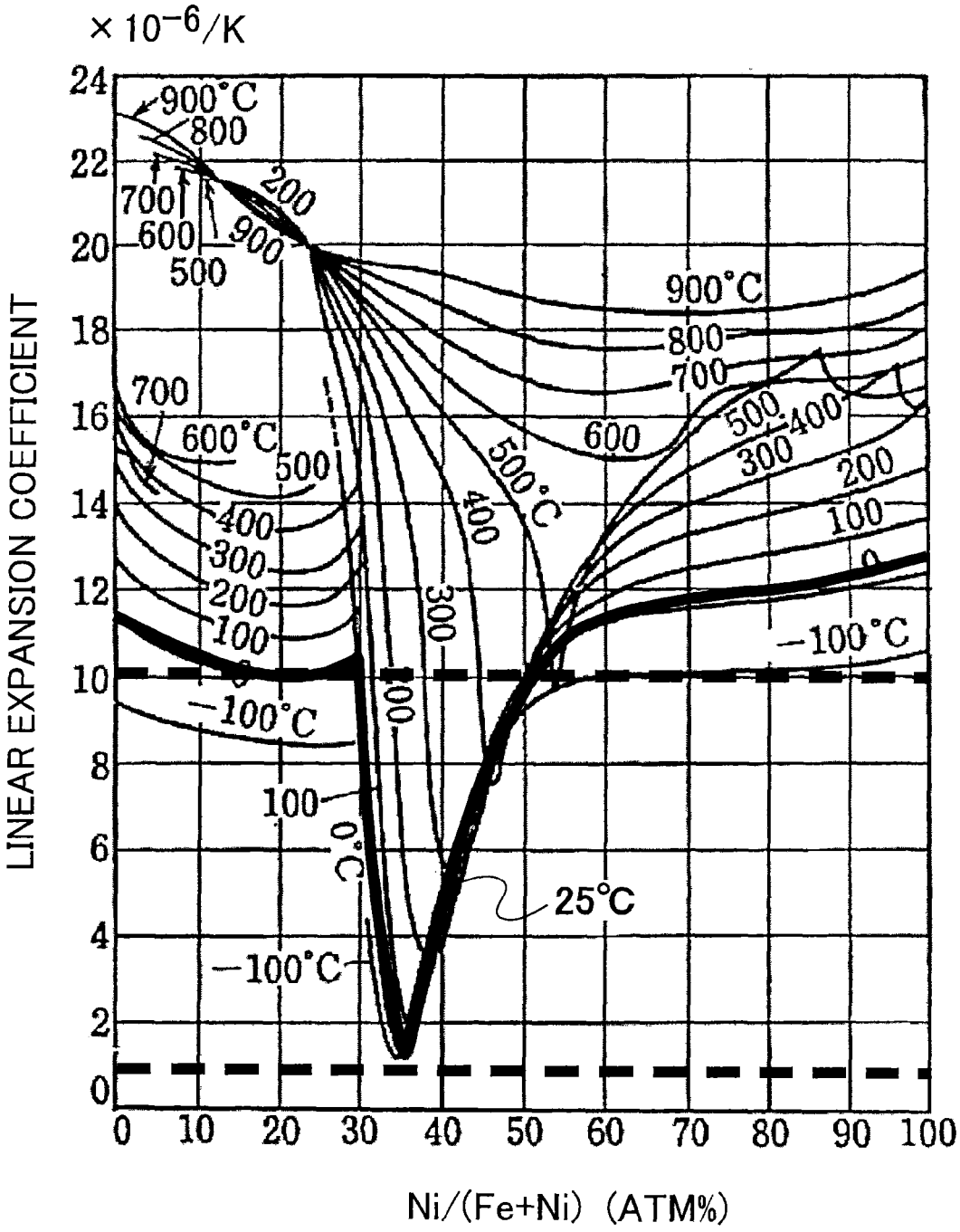
FIG. 5 is a diagram illustrating the linear expansion coefficient of the FeNi alloy.

FIG. 5 is a diagram illustrating the linear expansion coefficient of the FeNi alloy. For example, it is understood that when 30 mass % or more and 50 mass % or less of Ni/(Fe+Ni) is included, the linear expansion coefficient (thick line in the drawing) at 25° C. (room temperature) is $1\times10^{-6}$/K or more and $10\times10^{-6}$/K or less. The alloy in the case of 36 mass % is the invar alloy and the alloy in the case of 42 mass % is the 42Alloy. It is desirable that 35 mass % or more and 50 mass % or less of Ni/(Fe+Ni) is included in order to make the linear expansion coefficient low.

Figure 6:
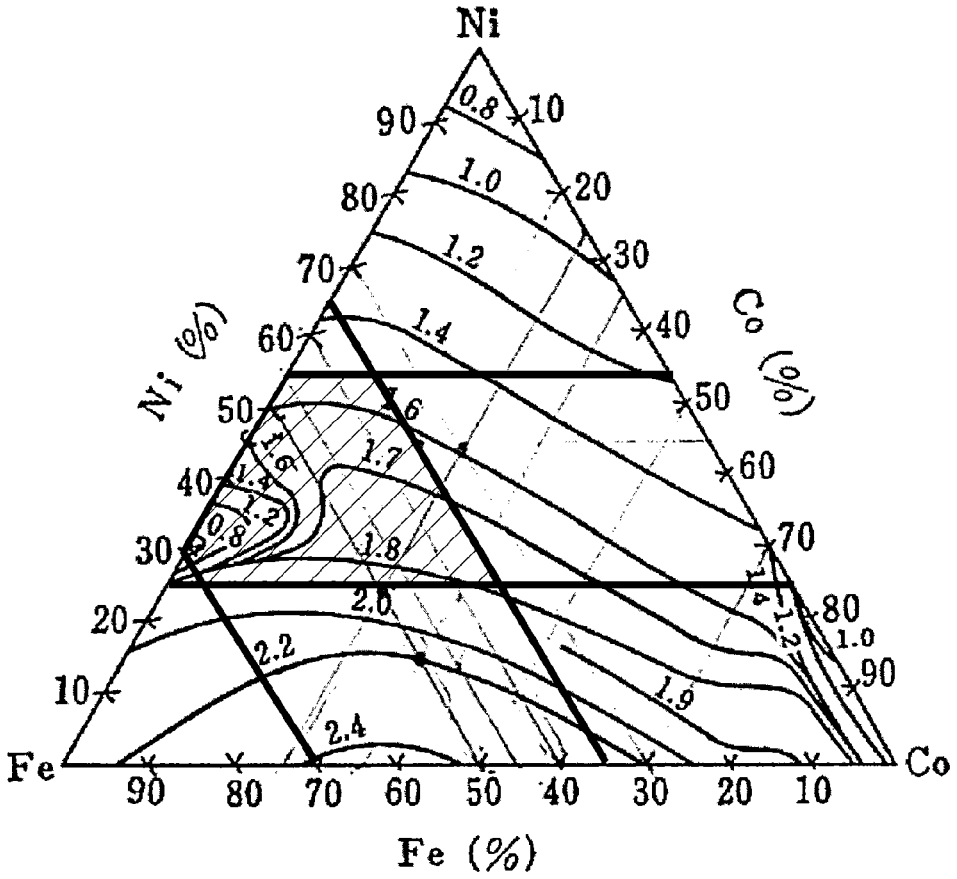
FIG. 6 is a triangular diagram of the FeCoNi alloy.

FIG. 6 is a triangular diagram of the FeNiCo alloy. The numerals in the diagram indicate the saturation magnetization (unit: T (tesla)) at room temperature. When the mass ratio of the elements in the FeCoNi alloy is expressed by aFe-bNi-cCo ($a+b+c=100$), $35\leq a\leq 70$ and $25\leq b\leq 55$ (portion with oblique lines in the drawing) are desirably satisfied from the viewpoint of satisfying the above range of the linear expansion coefficient. It is noted that 54Fe-29Ni-17Co corresponds to the Kovar® alloy.

The electric resistance of the radio wave absorber is 10 MΩ·cm or more, preferably 100 MΩ·cm or more, and more preferably 1000 MΩ·cm or more. Within this range, the reflection of the radio wave is suppressed and the high radio wave absorbing characteristic with high loss can be obtained. The electric resistance is measured by providing an Au electrode with a diameter of 5 mm by a sputtering process on each of front and back surfaces of a disc-like radio wave absorber with a diameter of 15 mm and a thickness of 1 mm, and reading the current value when a voltage of 10 V is applied between the electrodes. Since the current value has time dependence, the value obtained after two minutes from the voltage application is used as the measurement value.

A structure of the radio wave absorber is hereinafter described.

(Core-Shell Type Particle)

The shape of the core-shell type particle is described. The core-shell type particle may be spherical but is preferably a flat shape or a bar-like shape with a high aspect ratio (e.g., 10 or more). The bar-like shape includes a spheroid. Here, "aspect ratio" refers to the ratio of the height to the diameter (height/diameter). In the case of the spherical shape, the height and the diameter are equal; therefore, the aspect ratio is 1. The aspect ratio of the flat particle is (diameter/height). The aspect ratio of the bar-like shape is (bar length/diameter of bar bottom). The aspect ratio of the spheroid is (major axis/minor axis).

When the aspect ratio is increased, the magnetic anisotropy depending on the shape can be added and the high-frequency characteristic of the magnetic permeability can be improved. Moreover, when the core-shell type particles are unified to fabricate a desired member, the magnetization can be easily oriented by the magnetic field; thus, the high-frequency characteristic of the magnetic permeability can be further improved. Moreover, by increasing the aspect ratio, the critical particle diameter of the core portion to be the single-magnetic-domain structure can be increased to, for example, more than 50 nm. In the case of the spherical core portion, the critical particle diameter to produce the single-magnetic-domain structure is approximately 50 nm.

In the flat magnetic core-shell type particle with a large aspect ratio, the critical particle diameter can be increased and the high-frequency characteristic of the magnetic permeability does not deteriorate. Since the synthesis is generally easier when the particle diameter is larger, the aspect ratio is preferably larger from the viewpoint of fabrication. By increasing the aspect ratio further, the volume filling ratio of the core-shell type particle can be increased when the radio wave absorber is fabricated using the core-shell type particle 1. Therefore, the saturation magnetization per unit volume and per unit mass of the radio wave absorber can be increased. As a result, the magnetic permeability of the radio wave absorber can also be increased.

It is noted that the diameter obtained by averaging the longest diagonal line and the shortest diagonal line of the individual particle from the TEM observation is used as the particle diameter of the particular core-shell type particle 1, and the average particle diameter of the core-shell type particles 1 is obtained from the average of a number of particle diameters.

(Core Portion)

The core portion of the core-shell type particle 1 includes at least one kind of magnetic metal element selected from the first group consisting of Fe, Co, and Ni (metal element of the first group), and at least one kind of metal element selected from the second group consisting of Mg, Al, Si, Ca, Zr, Ti, Hf, Zn, Mn, a rare-earth element, Ba, and Sr (metal element of the second group).

By the inclusion of the magnetic metal element of the first group in the core portion 10, the radio wave absorber 100 can have higher magnetic permeability. The oxide of the metal element of the second group has low standard generation Gibbs energy and is easily oxidized. Thus, the element of the second group disposed near the surface of the core portion 10 easily forms an oxide layer 21. Moreover, the electrical insulating property of the radio wave absorber 100 is stabilized by having the element of the second group included in the oxide layer 21.

The magnetic metal (metal element of the first group) included in the core portion 10 may be present either as the single metal element or as the alloy. In particular, the FeNi-based alloy, the FeCo-based alloy, or the FeNiCo-based alloy is preferably used in the core portion 10 because the low linear expansion coefficient can be achieved.

Among the elements belonging to the second group, Al and Si particularly easily form the solid solution with Fe, Co, and Ni, which are the main components of the core portion, and are therefore preferable for improving the thermal stability of the core-shell type particle 1. In particular, the use of Al is preferable because the thermal stability and the oxidation resistance can be increased. It is more preferable that Al and Si are contained at the same time because the aggregation and the growth of the core-shell type particle 1 are suppressed and the characteristics of the composite member to be obtained such as the high-frequency magnetic permeability, the thermal stability, and the oxidation resistance are further improved.

The characteristics can be improved alternatively by adding another kind of element of the second group to the element of the second group. It is preferable to select the active metal element such as the rare-earth element as the element to be added because the aggregation and the growth of the core-shell type particle 1 are suppressed and the characteristics of the composite member to be obtained such as the high-frequency magnetic permeability, the thermal stability, and the oxidation resistance are further improved. For example, the rare-earth element such as Y is preferably added to the element including at least one of Al and Si.

Alternatively, the similar effect can be expected by differentiating the valence of the other kind of element of the second group which is to be added from the valence of the element of the second group which is included in the core portion 10. Further alternatively, the similar effect can be expected by increasing the radius of the atom of the other kind of element to be added belonging to the second group to be larger than the radius of the atom of the element belonging to the second group.

The material of the core portion may include the solid solution of a carbon atom or a nitrogen atom.

The compositions of the elements of the first group and the second group included in the core portion can be analyzed by a method below, for example. For example, the analysis of the non-magnetic metal such as Al may employ the ICP (Inductively Coupled Plasma) emission spectroscopy, TEM-EDX (Energy Dispersive X-ray Fluorescence Spectrometer), XPS (X-ray Photoelectron Spectroscopy), SIMS (Secondary Ion Mass Spectrometry), or the like. According to the ICP emission spectroscopy, the composition of the core portion can be measured by comparing the analysis results of the magnetic metal particle portion (core portion) dissolved by weak acid, the residue left after the shell layer is dissolved by alkaline, strong acid, or the like, and the entire particle; in other words, the amount of the non-magnetic metal in the core portion can be separately measured. Moreover, according to TEM-EDX, the core portion or the shell portion can be selectively irradiated with an electron beam to quantify the element ratio of each portion. In addition, according to XPS, the binding state of the elements included in the core portion or the shell layer can be examined.

The state of the solid solution of the composition belonging to the second group relative to the composition belonging to the first group included in the core-shell type particle can be determined based on the lattice constant measured by XRD (X-ray diffraction). For example, when Fe includes the solid solution of Al or carbon, the lattice constant of Fe is changed depending on the amount of the solid solution. In the case of bcc-Fe which does not contain the solid solution, the lattice constant is ideally approximately 2.86; when the solid solution of Al is included, the lattice constant is increased and the inclusion of the solid solution of approximately 5 mass % of Al increases the lattice constant by approximately 0.005 to 0.01. In the case of the inclusion of the solid solution of approximately 10 mass % of Al, the lattice constant is increased by approximately 0.01 to 0.02. The lattice constant is increased also when the bcc-Fe includes the solid solution of carbon, and the lattice constant is increased by approximately 0.001 when the solid solution of approximately 0.02 mass % of carbon is included. In this manner, the lattice constant of the magnetic metal can be obtained through the XRD measurement of the core portion and from the lattice constant, whether the solid solution is included or not or how much the solid solution is included can be easily determined. Further, whether the solid solution is included or not can be checked by the diffraction pattern of the particle by the TEM.

The core portion 10 may be either polycrystalline or single crystal; however, a single-crystal state is preferable. When the composite member in which the core-shell type particle including the single-crystal core portion is used is applied to the high-frequency device, the axis of easy magnetization can be aligned to enable the control of the magnetic anisotropy. Therefore, the high-frequency characteristic can be improved as compared to the high-frequency magnetic material containing the core-shell type particle including a polycrystalline core portion.

The amount of elements of the second group included in the core portion 10 is preferably 0.001 mass % or more and 20 mass % or less relative to the amount of the elements of the first group. When the content of the element of the second group is greater than 20 mass %, the saturation magnetization of the core-shell type particle 1 may be deteriorated. The preferable amount from the viewpoints of the high saturation magnetization and the solid solubility ranges from 1 mass % or more and 10 mass % or less.

In the core portion 10, the average particle diameter in the particle size distribution is 1 nm or more and 1000 nm or less, preferably 1 nm or more and 100 nm or less, and more preferably 10 nm or more and 50 nm or less. When the average particle diameter is less than 10 nm, the superparamagnetism may occur and the magnetic flux of the composite member to be obtained is deteriorated. On the other hand, when the average particle diameter is greater than 1000 nm, the eddy current loss is increased in the high-frequency region of the composite member to be obtained, and the magnetic characteristic in the target high-frequency region may be deteriorated. When the particle diameter of the core portion 10 in the core-shell type particle 1 is increased, the multi-magnetic-domain structure is more stable in terms of energy than the single-magnetic-domain structure. On this occasion, the high-frequency characteristic of the magnetic permeability of the radio wave absorber 100 to be obtained is lower in the core-shell type particle 1 with the multi-magnetic-domain structure than in the core-shell type particle 1 with the single-magnetic-domain structure.

In view of the above, when the core-shell type particle 1 is used as the radio wave absorber, the core-shell type particle 1 is preferably present with the single-magnetic-domain structure. The critical particle diameter of the core portion 10 maintaining the single-magnetic-domain structure is approximately 50 nm or less; therefore, it is preferable that the average particle diameter of the core portion is 50 nm or less. From the above points, the average particle diameter of the core portion 10 is 1 nm or more and 1000 nm or less, preferably 1 nm or more and 100 nm or less, and more preferably 10 nm or more and 50 nm or less.

(Shell Layer)

The shell layer 20 coats at least a part of the core portion 10 and includes at least the oxide layer 21 as aforementioned. The shell layer 20 may further include the carbon-contained material layer 22.

The shape of the oxide layer 21 and the carbon-contained material layer 22 in the shell layer is not particularly limited but preferably has the structure in which the oxide layer 21 is in close contact with the core portion 10. The proportion of the metal element of the second group relative to the magnetic metal of the first group is preferably higher in the oxide layer 21 than in the core portion 10. In other words, it is desirable that the ratio of the number of atoms of the element which belongs to the second group to the number of the atoms of the element which belongs to the first group in the oxide layer 21 is higher than the ratio of the number of atoms of the element which belongs to the second group to the number of the atoms of the element which belongs to the first group in core portion 10. This is because the oxidation resistance of the particle is improved more.

(Shell Layer/Oxide Layer)

The oxide layer 21 includes at least one kind of element of the second group, which is one of the composition of the core portion 10. In other words, the core portion 10 and the oxide layer 21 include the common element of the second group. In the oxide layer 21, the oxide is formed by the element which is common to the core portion 10. The oxide layer 21 is preferably the layer obtained by oxidizing the element of the second group of the core portion 10.

The thickness of the oxide layer 21 is preferably in the range of 0.01 to 5 nm. Over this range, the structure ratio of the magnetic metal may decrease and the saturation magnetization of the particle may deteriorate. Below this range, on the other hand, the effect of stabilizing the oxidation resistance by the oxide layer 21 cannot be expected.

The amount of oxygen in the oxide layer 21 is not particularly limited; however, if the amount of oxygen is measured as the core-shell type particle 1, oxygen is preferably contained by 0.5 mass % or more and 10 mass % or less to the mass of the entire particle, more preferably 1 mass % or more and 10 mass % or less, and much more preferably 2 mass % or more and 7 mass % or less. Over this range, the structure ratio of the magnetic metal may decrease so that the saturation magnetization of the particle is deteriorated. Below this range, on the other hand, the effect of stabilizing the oxidation resistance by the oxide layer 21 cannot be expected.

In a method of determining the quantity of the oxygen, if the surface of the core portion is coated with the carbon-contained material layer 22, for example, 2 to 3 mg of a measurement sample in a carbon vessel is heated at approximately 2000° C. by high-frequency heating in an inert atmosphere of He gas or the like using the Sn capsule as a combustion assistant. In the oxygen measurement, the carbon vessel and the oxygen in the sample react with each other through the high-temperature heating and by detecting the generated carbon dioxide, the amount of oxygen can be calculated. In the case of coating the magnetic particle with the organic compound whose main chain includes a hydrocarbon, only the amount of oxygen originated from the oxide layer 21 is separated and determined by controlling the temperature and changing the combustion atmosphere. When the amount of oxygen in the core-shell type particle aggregate is 0.5 mass % or less, the proportion of the oxide layer 21 in the shell layer 20 is decreased, in which case the heat resistance and the thermal reliability are deteriorated. When the amount of oxygen in the core-shell type particle 1 is 10 mass % or more, the oxide layer 21 is easily separated more.

(Shell Layer/Carbon-Contained Material Layer)

As the carbon-contained material layer 22 constituting a part of the shell layer 20, a hydrocarbon gas reaction product, a metal carbide, an organic compound or the like can be used. By the presence of this layer, the oxidation of the metal material of the core portion 10 can be suppressed more effectively and the oxidation resistance is improved.

The carbon-contained material layer 22 preferably has an average thickness of 0.1 nm or more and 10 nm or less, and more preferably 1 nm or more and 5 nm or less. The thickness herein referred to indicates the length along the straight line connecting the outer edge and the center of the core-shell type particle 1. When the thickness of the carbon-contained material layer 22 is less than 1 nm, the oxidation resistance is insufficient. Moreover, the resistance of the composite member is remarkably deteriorated to easily generate the eddy current loss, in which case the high-frequency characteristic of the magnetic permeability may be deteriorated.

In the case where the thickness of the carbon-contained material layer 22 is greater than 10 nm, when a desired member is fabricated by unifying the core-shell type particles coated with the carbon-contained material layer, the filling ratio of the core portion 10 included in the member is decreased by the thickness of the shell layer 20; thus, the saturation magnetization of the radio wave absorber 100 to be obtained may be deteriorated and the magnetic permeability may be deteriorated accordingly.

The thickness of the carbon-contained material layer 22 can be obtained by the TEM observation.

The hydrocarbon gas reaction product uses as a film, a material generated by decomposing the hydrocarbon gas on the surface of the core portion 10. The hydrocarbon gas corresponds to, for example, acetylene gas, propane gas, methane gas, or the like. This reaction product is, although not definitely, considered to contain a thin film of carbon. The carbon-contained material layer 22 preferably has appropriate crystallinity.

For evaluating the crystallinity of the carbon-contained material layer 22, specifically, there is a method of evaluating the crystallinity of the carbon-contained material layer by the hydrocarbon vaporizing temperature. An apparatus such as TG-MS (thermogravimetry-mass spectrometer) is used and the analysis is conducted under the atmospheric pressure and the hydrogen gas flow. While the generation of the hydrocarbon (e.g., the mass number is 16) is monitored, the crystallinity is evaluated based on the temperature at which the amount of generation is the peak. The hydrocarbon vaporizing temperature is preferably in the range of 300° C. or more and 650° C. or less, and more preferably 450° C. or more and 550° C. or less. This is because when the hydrocarbon vaporizing temperature is higher than 650° C., the carbon-contained material layer 22 becomes too dense, and so the generation of the oxide layer 21 is interrupted. Further, when the hydrocarbon vaporizing temperature is lower than 300° C., the carbon-contained material layer 22 has too many defects, and so the excessive oxidation progresses.

The carbon-contained material layer 22 may include a metal carbide material. The carbide in this case corresponds to the carbide of the element of the first or second group that is included in the core portion 10. Above all, silicon carbide and iron carbide are preferable because those carbides are stable and have the appropriate thermal reliability.

The carbon-contained material layer 22 may be the organic compound. The organic compound layer may be formed on the surface of the hydrocarbon gas reaction product. The organic compound is desirably the organic polymers or oligomers whose main chain is formed by any of carbon, hydrogen, oxygen, and nitrogen.

This organic compound material is solid under room temperature and atmospheric pressure. The organic compound can be selected from the organic polymers or the oligomers, either a natural compound or a synthetic compound, for example. The polymers or oligomers of this embodiment can be obtained by known radical polymerization or polycondensation.

The organic compound can be selected from, for example, a single polymer and a copolymer including polyolefins, polyvinyls, polyvinylalcohols, polyesters, polylactic acids, polyglycols, polystyrenes, polymethylmethacrylates, polyamides, polyurethanes, polycelluloses, or an epoxy compound. The organic compound can be selected from polysaccharides of natural polymers such as gelatin, pectin, and carrageenan.

The shell layer 20 including the organic compound preferably has a thickness of 2 nm or more.

The oxygen transmission coefficient of the organic compound is preferably $1\times10^{-17}$ [$cm^3$(STP)·cm/$cm^2$·s·Pa] or more under normal temperature and normal pressure. In other words, the oxygen transmission coefficient is desirably greater than or equal to $1\times10^{-17}$ [$cm^3$(STP)·cm/$cm^2$·s·Pa]. When the oxygen transmission coefficient is less than the above value, the formation of the oxide layer 21 does not progress in the formation of the oxide-carbon-metal particle aggregate, that is, the core-shell type particle 1; in this case, the characteristics may be deteriorated.

In the measurement of the oxygen transmission coefficient, a known technique can be employed; for example, a gas chromatography method of a differential pressure type based on JIS K7126-1 (differential pressure method) can be used. That is, a film of the organic compound is prepared, and pressure is applied on one side and reduced on the other transmission side; thus, the measurement can be conducted. On this occasion, the transmitted gas is separated through the gas chromatography and the amount of gas transmission per unit time is obtained using a thermal conduction detector (TCD) and a flame ionization detector (FID), whereby the oxygen transmission coefficient can be calculated.

In this embodiment, the carbon-contained material layer 22 and the oxide layer 21 of the shell layer 20 exhibit the following operation in the manufacturing process for the radio wave absorber 100.

When the shell layer 20 is formed of the carbon-contained material layer 22 only, the oxidation of the core portion 10 suddenly progresses due to, for example, the crack of the carbon-contained material layer 22, and heat is generated partially. Therefore, oxidation sequentially occurs involving the particles disposed around, which results in the aggregation and growth of the core-shell type particle 1.

When the shell layer 20 includes the oxide layer 21 only, the inhomogeneous portion is formed in the oxide composition, and the area where the oxide layer mainly including the element of the first group but not including the oxide of the metal element of the second group is present may increase. The oxide of the element of the second group suppresses the diffusion of the element and is highly protective for the core portion but the oxide of the element of the first group causes more element diffusion than the oxide of the element of the second group and is less protective for the core portion 10. Therefore, when the oxide of the element of the first group is much contained in the oxide layer 21, the excessive oxidation of the core portion 10 progresses.

When the shell layer 20 includes the oxide layer 21 and the carbon-contained material layer 22 appropriately, the oxidation resistance of the core-shell type particle 1 can be maintained well. Since the shell layer 20 exists on the surface of the core-shell type particle 1, the core-shell type particles are brought into contact with each other through the shell layer 20. Therefore, since the possibility of directly forming the interface between the metal elements of the core portion 10 is low, the aggregation and particle growth involving the diffusion of the metal elements are unlikely to occur. Moreover, the separation of the oxide layer 21 can be suppressed and the radio wave absorber 100 with excellent heat resistance and thermal stability of the magnetic characteristic over a long period can be achieved.

The proportion of the mass between the oxide layer 21 and the carbon-contained material layer 22 is preferably in the range of 1:20 to 1:1.

(Manufacturing Method for Core-Shell Type Particle)

A manufacturing method for the core-shell type particle 1 according to this embodiment is described. The manufacturing method for the core-shell type particle 1 from which the carbon coating has been removed includes the following steps.

(1) A step of forming a metal-contained particle by inputting into plasma at least one kind of magnetic metal element selected from the first group of Fe, Co, and Ni and at least one kind of metal element selected from the second group of Mg, Al, Si, Ca, Zr, Ti, Hf, Zn, Mn, a rare-earth metal element, Ba, and Sr (alloy particle formation step).

(2) A step of coating the surface of the metal-contained particle with the carbon-contained material layer (carbon coating step).

(3) A step of oxidizing the metal-contained alloy particle coated with the carbon under the oxygen-contained atmosphere (oxidizing step).

(4) A step of removing the carbon-contained material layer formed in the carbon coating step (2) that is employed as necessary (carbon removing step).

Description is made of the steps (1) to (4).

((1): Alloy Particle Formation Step)

The manufacture of the alloy particle serving as the core portion 10 preferably employs the thermal plasma method or the like. Description is hereinafter made of the manufacturing method for the core portion in which the thermal plasma method is used.

First, plasma is generated by supplying gas mainly containing argon (Ar) as the gas for generating plasma into a high-frequency inductive heating plasma apparatus. Next, the powder of the magnetic metal (metal belonging to the first group) and the powder of the metal belonging to the second group are sprayed to the plasma.

The process for manufacturing the core portion 10 is not limited to the thermal plasma method but is preferably performed by the thermal plasma method because the material tissue can be controlled at the nano-level and the mass synthesis is possible.

As the powder of the metal sprayed into the argon gas, the powder of the magnetic metal in which the magnetic metal belonging to the first group and the metal of the second group are dissolved to form the solid solution and which has an average particle diameter of 1 μm or more and 10 μm or less can be used. The powder of the solid solution with an average particle diameter of 1 μm or more and 10 μm or less can be synthesized by an atomizing method or the like. By the use of the powder of the solid solution, the core portion with uniform composition can be synthesized by the thermal plasma method.

Note that the core portion 10 including the solid solution of nitrogen is also preferable because the magnetic anisotropy is high. For forming the solid solution of nitrogen, a method is given in which argon and nitrogen are introduced as the gas for generating plasma, for example; however, the present disclosure is not limited thereto.

The composition of the alloy particle is adjusted so that the linear expansion coefficient of the alloy particle serving as the core portion 10 to be generated is $1\times10^{-6}$/K or more and $10\times10^{-6}$/K or less.

((2): Carbon Coating Step)

Next, the step of coating the core portion 10 with the carbon-contained material layer 22 is described. In this step, (a) a method of causing reaction of the hydrocarbon gas on the surface of the core portion 10, (b) a method of producing a carbide through the reaction between carbon and the metal element included in the core portion 10 on the surface of the core portion 10, (c) a method of coating the surface of the core portion with the organic compound having a main chain including hydrocarbon, or the like can be employed.

In the method of causing the reaction of the hydrocarbon gas, which corresponds to the method (a) above, carrier gas is introduced to the material surface of the core portion together with the hydrocarbon gas to cause the reaction; the product obtained by the reaction is used to coat the surface of the core portion 10. The hydrocarbon gas to be used is not particularly limited; for example, acetylene gas, propane gas, methane gas, or the like is given.

The alloy mainly containing Fe, Co, or Ni is known as the catalyst for decomposing the hydrocarbon gas to separate out carbon. Through this reaction, the favorable carbon-contained material layer 22 can be formed. In other words, the carbon layer that prevents the contact between the core portions 10 is obtained by bringing the alloy particle mainly containing Fe, Co, or Ni and the hydrocarbon gas into contact with each other in the appropriate temperature range that enables the catalyst operation.

The reaction temperature for the alloy particle mainly containing Fe, Co, or Ni and the hydrocarbon gas is preferably 200° C. or more and 1000° C. or less though the temperature may be different depending on the species of the hydrocarbon gas. When the temperature is lower than the above, the carbon does not separate out sufficiently, which is not enough for the coating. On the other hand, when the temperature is higher than the above, the potential of carbon becomes too high, so that the separation excessively progresses.

The reaction temperature for the hydrocarbon gas and the metal forming the shell layer 20 affects the stability of the carbon-contained material layer 22, that is, the crystallinity thereof. The carbon-contained material layer 22 formed at high reaction temperature is vaporized into the hydrocarbon gas at high temperature and the carbon-contained material layer 22 formed at low reaction temperature is vaporized into the hydrocarbon gas at low temperature.

In this manner, the stability of the carbon-contained material layer 22 can be evaluated by the heating experiments in hydrogen. With the use of the apparatus employing the TG-MS method or the like, the hydrocarbon vaporizing temperature can be evaluated by measuring the temperature at which the vaporizing concentration becomes the peak. For example, the temperature at which the generation of the hydrocarbon gas with a mass number of 16 is the peak is used as the thermal decomposition peak temperature, and as this peak temperature is higher, the carbon-contained material layer can have higher stability and as this peak temperature is lower, the carbon-contained material layer can have lower stability.

Moreover, a method of simultaneously spraying a raw material including carbon and a raw material of the shell layer 20 is given. The raw material including carbon to be used in this method may be pure carbon, for example; however, the present disclosure is not limited thereto.

The second method (b) is preferable in that the core portion 10 can be coated with uniform carbon; however, the step of coating the surface of the core portion 10 with carbon is not necessarily limited to the above two methods.

As a method of carbonizing the metal element on the material surface of the core portion 10, a known method can be employed. For example, a method of forming the carbide through the reaction with acetylene gas or methane gas by CVD is given. With this method, the thermally stable carbon-contained material layer 22 such as silicon carbide or iron carbide can be formed.

Next, as the method (c) of coating the organic compound, various known methods can be employed. For example, a physical chemical nano-encapsulating method and a chemical nano-encapsulating method are known. The physical chemical method can be selected from phase separation, coacervation, and other known physical chemical methods for enabling the nano-encapsulation. The chemical method can be selected from interface polycondensation, interface polymerization, polymerization in dispersion medium, in-situ polycondensation, emulsion polymerization, and other known chemical methods for enabling the nano-encapsulation. The carbon-contained material layer 22 of the organic compound is bound with the core portion 10 or the oxide layer 21 through the physical binding without the covalent bond.

Through the above method, the core of the magnetic metal (including the metal particle stabilized by the protective colloid) 10 and the core-shell system coated with the polymer with a thickness of more than 2 nm can be obtained.

Alternatively, the magnetic metal nano-particle can be input into a polymer solution to be the shell and the solution can be homogenized to form the shell including the organic compound. This method is more preferable from the industrial point of view because the method is simple.

In this method, it is not always necessary that the particles exist alone and may exist as an aggregate having an organic compound layer with desired thickness formed therein between the core particles including the magnetic metal.

((3): Oxidizing Step)

Description is made of the step of oxidizing the core portion 10 coated with carbon obtained in the above step in the presence of oxygen. The oxide layer 21 is formed at the interface between the core portion 10 and the carbon-contained material layer 22 or the oxide layer 21 is formed by partially oxidizing and decomposing the carbon-contained material layer 22.

This process oxidizes the core portion 10; in particular, the metal belonging to the second group included in the core portion is preferably oxidized. In other words, at least one non-magnetic metal selected from Mg, Al, Si, Ca, Zr, Ti, Hf, Zn, Mn, a rare-earth metal element, Ba, and Sr is oxidized to form the oxide layer 21 on the surface of the core portion 10.

The oxidizing atmosphere is not particularly limited and may be air atmosphere, oxygen, $CO_2$, or gas including steam. In the case of using oxygen, when the oxygen concentration is high, the oxidation may progress instantly to cause the particles to aggregate due to the excessive heat generation or the like. Therefore, it is desirable to use the gas including 5% or less, and more desirably 0.001% to 3%, of oxygen in the inert gas such as Ar or $N_2$, but the present disclosure is not limited thereto.

The oxidation in the above atmosphere may be conducted under the heating environment. The temperature in this case is not particularly limited but the temperature is preferably in the range of room temperature to approximately 300° C. This is because the oxidation progresses less easily below this temperature range and the oxidation drastically occurs and the particles aggregate over this temperature range.

The atmosphere gas and the temperature used in the oxidizing step are preferably selected based on the crystallinity of the carbon-contained material layer 22, that is, the balance between the stability and the film thickness. In other words, in the case of using the carbon-contained material layer 22 with high stability, the oxidation is preferably conducted in the state that the oxygen potential is high and in the case of using the carbon-contained material layer 22 with low stability, the oxidation is preferably conducted in the state that the oxygen potential is low.

In the case of using the carbon-contained material layer 22 with large thickness, the oxidation is preferably conducted in the state that the oxygen potential is high, and in the case of using the carbon-contained material layer 22 with small thickness, the oxidation is preferably conducted in the state that the oxygen potential is low. In the case where the oxidation is conducted in a short period of time, the oxygen gas concentration may be approximately 10%. By the manufacturing method as above, the core-shell type particle whose shell layer 20 includes the carbon-contained material layer 22 and the oxide layer 21 can be manufactured.

((4): Carbon Removing Step)

When the core-shell type particle 1 obtained by the steps up to the above step is heated in, for example, a hydrogen atmosphere at temperatures of several hundreds of degrees, the carbon-contained material layer 22 of the core-shell type particle is removed entirely or partially. Therefore, the core-shell type particle 1 in which the surface of at least a part of the core portion is coated with the oxide layer 21 is obtained. By this step, the filling ratio of the particles of the radio wave absorber 100 can be increased. In the case of removing the organic compound such as the aforementioned organic polymers and oligomers, the thermal decomposition may be conducted in the presence of oxygen or hydrogen to perform the decomposition and removal.

Although the atmosphere of the heat treatment is not particularly limited, the reducing atmosphere for making the carbon into the hydrocarbon gas and the oxidizing atmosphere for making the carbon into carbon oxide gas are given.

The oxide layer 21 including the element of the second group is generally stable at temperatures up to around 1000° C. in either the reducing or oxidizing atmosphere gas, and decomposing and vaporizing the oxide layer 21 are difficult. On the other hand, the carbon or the carbide layer becomes the hydrocarbon gas through the heat treatment at temperatures of several hundreds of degrees in hydrogen. Similarly, the carbon or the carbide layer becomes the carbon oxide gas through the heat treatment at temperatures of several hundreds of degrees in the oxidizing atmosphere. Therefore, by selecting the heating atmosphere, just the carbon-contained material layer 22 can be removed as selected with the oxide layer 21 left.

The reducing atmosphere may be, for example, the atmosphere of argon or nitrogen including the reducing gas such as methane or hydrogen. The hydrogen gas atmosphere with a concentration of 50% or more is more preferable because the carbon-contained material layer 22 can be removed more efficiently.

The oxidizing atmosphere may be, for example, gas including an oxygen atom, such as oxygen, carbon dioxide, or steam, or a mix gas including the gas including the oxygen atom and nitrogen or argon.

The atmosphere of nitrogen or argon including the reducing gas is preferably air flow with a speed of 10 mL/min or more.

The heating temperature in the reducing atmosphere is not particularly limited and is preferably in the range of 100° C. to 800° C. In particular, the temperature range of 300° C. or more and 800° C. or less is preferable. When the heating temperature is lower than 100° C., the reducing reaction may become slower. On the other hand, when the heating temperature is higher than 800° C., the aggregation or particle growth of the separated metal microparticles may proceed in a short time.

More preferably, the selection is made based on the crystallinity of the carbon-contained material layer 22, that is, the stability of the carbon-contained material layer 22. In other words, in the case of the carbon-contained material layer 22 with high stability, the temperature is preferably set to be relatively high; in the case of the carbon-contained material layer 22 with low stability, the temperature is preferably set to be relatively low.

The heat treatment temperature and time are not particularly limited as long as at least the carbon-contained material layer 22 can be reduced.

The amount of carbon contained in the core-shell type particle 1 after the process of removing carbon with the reducing gas is preferably 1 mass % or less because the electric influence is reduced.

In the process of removing the carbon in the oxidizing atmosphere, air, the mix gas such as oxygen-argon or oxygen-nitrogen, humidified argon whose dew point is controlled, or humidified nitrogen is used, for example.

In the method of removing the carbon in the oxidizing atmosphere, the oxygen partial pressure is preferably as low as possible. Alternatively, a method of removing the carbon-contained material layer 22 using hydrogen and the mix gas including the oxygen atom can be employed. In this case, since the carbon removal and oxidation can be advanced at the same time, the oxide layer 21 that is more stable can be formed.

The mix gas is not particularly limited and may be the mix gas of hydrogen and argon-oxygen, hydrogen gas whose dew point is controlled, or the like.

The core-shell type particles obtained thus have the surface coated with the oxide film and thus do not easily aggregate.

Before this carbon removing step, the core-shell type particle 1 is irradiated with the plasma or energy beam under the oxygen-contained atmosphere or inert atmosphere to damage the crystallinity of the carbon-contained material layer; thus, the oxygen transmission properties of the carbon-contained material layer 22 can be controlled and the oxide layer with the appropriate thickness can be formed under the carbon-contained material layer 22. The preferred energy beam is an electron beam, an ion beam, or the like. The oxygen partial pressure of the applicable oxygen-contained atmosphere is preferably 10 Pa or more and $10^3$ Pa or less. Over this range, the excitation or generation of the plasma, the electron beam, or the ion beam becomes difficult; below this range, the effect from the irradiation with the plasma or the energy beam cannot be expected.

(Binding Layer (Binder))

The core-shell type particle 1 manufactured by the above embodiment is molded after being mixed with the binder (binding layer) 30 such as the resin or the inorganic material illustrated in FIGS. 1A and 1B and used as the radio wave absorber 100 with a desired shape, for example, a sheet-like shape.

The shape of the radio wave absorber 100 can be film-like, sheet-like or a bulk (pellet-like, ring-like, or rectangular).

In the core-shell type particle 1 and the radio wave absorber 100 of this embodiment, the material tissue can be identified or analyzed by the SEM or TEM, the diffraction pattern (including the confirmation of the solid solution) can be identified or analyzed using TEM diffraction or XRD. Moreover, the structure elements are identified and the quantities thereof can be determined by ICP emission analysis, X-ray fluorescence analysis, EPMA (Electron Probe Micro-Analysis), EDX, SIMS, TG-MS, oxygen-carbon analysis by the infrared absorption, or the like.

The resin that can be used as the binder (binding layer) 30 includes, but not limited to, the following: the polyester-based resin, the polyethylene-based resin, the polystyrene-based resin, the polyvinyl chloride-based resin, the polyvinyl butyral resin, the polyurethane resin, the cellulose-based resin, the ABS resin, the nitrile-butadiene-based rubber, the styrene-butadiene-based rubber, the epoxy resin, the phenol resin, the amide-based resin, the imide-based resin, or the copolymer including any of these.

As an alternative to the resin, an inorganic material such as the oxide, the nitride, or the carbide may be used as the binder. Specifically, the inorganic material may be the oxide including at least one metal selected from the group of Mg, Al, Si, Ca, Zr, Ti, Hf, Zn, Mn, a rare-earth metal element, Ba, and Sr, AlN, $Si_3N_4$, SiC, or the like.

The manufacturing method for the magnetic sheet is not particularly limited; for example, the core-shell type particles 1, the resin, and the solvent are mixed to form slurry, and the slurry is applied and dried to manufacture the magnetic sheet. Alternatively, a mixture of the core-shell type particles and the resin may be pressed into a sheet or a pellet. Further alternatively, the core-shell type particles 1 may be diffused in the solvent and deposited by a method of electrophoresis or the like.

The magnetic sheet may have a multilayer structure. By having the multilayer structure, the thickness can be easily increased and by alternately stacking the magnetic sheet and the non-magnetic insulating layer, the high-frequency magnetic characteristic can be improved. In other words, the magnetic layer including the core-shell type particle is formed into the sheet with a thickness of 100 μm or less and this sheet-like magnetic layer and the non-magnetic insulating oxide layer with a thickness of 100 μm or less are stacked alternately. The multilayer structure as above improves the high-frequency magnetic characteristic. Setting the thickness of the single magnetic layer to 100 μm or less can reduce the influence of the diamagnetic field when the high-frequency magnetic field is applied in the in-plane direction, and the magnetic permeability can be increased and moreover the high-frequency characteristic of the magnetic permeability is improved. A method of stacking the layers is not particularly limited and the layers can be stacked by crimping, heating, or burning the stacked magnetic sheets.

EXAMPLES

Detailed description is made below while comparing the examples and comparative examples.

Example 1

Argon is introduced into a chamber of a high-frequency inductive heating plasma apparatus as the gas for generating plasma at 40 L/min, thereby plasma is generated. The Fe powder with an average particle diameter of 10 μm, the Ni powder with an average particle diameter of 10 μm, and the Al powder with an average particle diameter of 3 μm, which are the raw materials, are sprayed into the plasma at 3 L/min in this chamber together with argon (carrier gas) so that the mass ratio of the powder is Fe:Ni:Al=65:35:5 relative to the total amount.

At the same time, methane gas as the raw material of the carbon coating is introduced into the chamber together with the Ar carrier gas, and the gas temperature and the powder temperature are controlled; thus, the magnetic metal particle in which the FeNiAl alloy particle is coated with carbon is obtained. The mass ratio of Fe:Ni:Al in the core portion was 65:35:5.

This carbon-coated magnetic metal particle is oxidized for approximately 5 minutes, whereby the aggregate of the core-shell type particles coated with the carbon-contained material layer 22 and the oxide layer 21 is obtained.

With the use of TEM, the carbon-contained material layer 22 and the oxide layer 21 are observed on the surface of the FeNiAl core. The average particle diameter of the core-shell type particle 1 is 19 nm and the amount of oxygen is 3.6 mass %. The analysis of oxygen was conducted using a gas analyzer (TC-600) manufactured by LECO in a manner that 2 to 3 mg of a measurement sample in a carbon vessel was heated at approximately 2000° C. by high-frequency heating in the He gas atmosphere using the Sn capsule as a combustion assistant. In the oxygen measurement, the carbon vessel and the oxygen in the sample reacted with each other through the high-temperature heating and by detecting the generated carbon dioxide, the amount of oxygen was calculated.

As for the thermal stability of the carbon-contained material layer 22 of this sample measured using TG-MS, the hydrogen gas with a purity of 99% or more is supplied at a flow rate of 200 mL/min under the atmospheric pressure and the temperature thereof is increased at a speed of 20° C./min; then, the peak of the mass number 16 due to the hydrocarbon gas is detected and the peak (hydrocarbon vaporizing temperature) is observed at around 499° C.

The core-shell type particle 1 and the resin are mixed at a mass ratio of 100:70 and 100:10 and the film thickness is increased to form an evaluation material. The volume filling ratio of the core-shell type particle 1 was 10% and 50%.

Example 2

An evaluation material in which the Fe:Ni:Al of the core portion was 58:42:5 in mass ratio and the volume filling ratio was 30% was fabricated by a method similar to that of Example 1.

Example 3

An evaluation material in which the Fe:Ni:Al of the core portion was 50:50:10 in mass ratio and the volume filling ratio was 10% and 50% was fabricated by a method similar to that of Example 1.

Example 4

An evaluation material in which the Fe:Ni:Co:Si of the core portion was 54:29:17:5 in mass ratio and the volume filling ratio was 30% was fabricated by a method similar to that of Example 1.

Example 5

An evaluation material in which the Fe:Ni:Co:Si of the core portion was 64:32:4:5 in mass ratio and the volume filling ratio was 30% was fabricated by a method similar to that of Example 1.

Example 6

An evaluation material in which the Fe:Ni:Co:Cr:Si of the core portion was 37:52:11:1:10 in mass ratio and the volume filling ratio was 30% was fabricated by a method similar to that of Example 1.

Comparative Example 1

An evaluation material in which the Fe:Ni:Al of the core portion was 65:35:5 in mass ratio and the volume filling ratio was 55% was fabricated by a method similar to that of Example 1.

Comparative Example 2

An evaluation material in which the Fe:Al of the core portion was 100:5 in mass ratio and the volume filling ratio was 40% was fabricated by a method similar to that of Example 1.

Comparative Example 3

An evaluation material in which the Fe:Co:Al of the core portion was 70:30:5 in mass ratio and the volume filling ratio was 30% was fabricated by a method similar to that of Example 1.

The compositions, the linear expansion coefficients, the particle saturation magnetization, and the volume filling ratios of the core-shell type particles of the above examples and comparative examples are shown in Table 1. Moreover, the ratios of the dielectric constant measured at 20° C. and 80° C. are shown in Table 1 as the increase rate of the dielectric constant.

In the measurement of the dielectric constant, a held electrode installed in a thermostat chamber and a network analyzer (4294A 10 Hz to 110 MHz, Agilent Technologies) were connected through a wire and the electrostatic capacitance of a flat parallel sample was measured, and the dielectric constant was calculated from the obtained value. Since the resonance influence was observed in the high-frequency range, the measurement was conducted in the range of 10 kHz to 10 MHz, and the value at 5 MHz was employed as the dielectric constant. The measurement temperatures were 80° C. and 20° C.

The determination was: ⊙ indicate the increase rate of the dielectric constant of 5% or less; ○ indicates the increase rate of the dielectric constant of 10% or less; and a letter of X indicates the increase rate of the dielectric constant of greater than 10%.

TABLE 1

| | Particle magnetic composition (numerical indicates mass %) | Particle non-magnetic composition (numerial indicates mass %) | Linear expansion coefficient ($\times 10^{-6}$/K) | Particle saturation magnetization (T) | Volume filling ratio (%) | Dielectric constant increase rate ($\in_{80° C.}/\in_{20° C.}$) | Deter-mination |
|---|---|---|---|---|---|---|---|
| Example1 | 65Fe—35Ni | 5Al | 1.2 | 1.0 | 10 | 1.02 | ◎ |
| | | | | | 50 | 1.08 | ○ |
| Example2 | 58Fe—42Ni | 5Al | 4 | 1.5 | 30 | 1.06 | ○ |
| Example3 | 50Fe—50Ni | 10Al | 9 | 1.6 | 10 | 1.03 | ◎ |
| | | | | | 50 | 1.09 | ○ |
| Example4 | 54Fe—29Ni—17Co | 5Si | 5 | 1.8 | 30 | 1.03 | ◎ |
| Example5 | 64Fe—32Ni—4Co | 5Si | 1 | 1.0 | 30 | 1.02 | ◎ |
| Example6 | 37Fe—52Ni—11Co—1Cr | 10Si | 1 | 1.5 | 30 | 1.02 | ◎ |
| Comparative Example1 | 65Fe—35Ni | 5Al | 1.2 | 1.0 | 55 | 1.13 | X |
| Comparative Example2 | Fe | 5Al | 12 | 2.1 | 40 | 1.24 | X |
| Comparative Example3 | 70Fe—30Co | 5Al | 15 | 2.4 | 30 | 1.12 | X |

As indicated by Table 1, the radio wave absorbing characteristic that is stable against the temperature change can be obtained when the volume filling ratio of the core-shell type particle is 10% or more and 50% or less and the linear expansion coefficient is $1\times10^{-6}$/K or more and $10\times10^{-6}$/K or less.

Note that this embodiment has described the case where the metal particle is the core-shell type particle. The core-shell type particle is preferably used from the viewpoint of improving the radio wave absorbing characteristic; however, the metal particle is not limited to the core-shell type particle. For example, the metal particle may include only the metal without the shell layer.

While certain embodiments have been described, these embodiments have been presented by way of example only, and are not intended to limit the scope of the inventions. Indeed, the radio wave absorber described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. A radio wave absorber comprising:

a plurality of metal particles including at least one kind of magnetic metal element selected from a first group consisting of Fe, Co, and Ni, each of the plurality of metal particles having a linear expansion coefficient of $1\times10^{-6}$/K or more and $10\times10^{-6}$/K or less; and a binding layer binding the metal particles and having higher resistance than the metal particle, wherein a volume filling ratio of the metal particles in the radio wave absorber is 10% or more and 50% or less.

2. The radio wave absorber according to claim 1, wherein the metal particle is a core-shell type particle including:

a core portion including at least one kind of magnetic metal element selected from the first group consisting of Fe, Co, and Ni, and at least one kind of metal element selected from a second group consisting of Mg, Al, Si, Ca, Zr, Ti, Hf, Zn, Mn, a rare-earth element, Ba, and Sr; and a shell layer coating at least a part of the core portion and having an oxide layer including at least one kind of the metal element selected from the second group, the metal element being included in the core portion.

3. The radio wave absorber according to claim 2, wherein the shell layer includes a carbon-contained material layer.

4. The radio wave absorber according to claim 1, wherein the electric resistance is 10 MΩ·cm or more.

5. The radio wave absorber according to claim 2, wherein oxygen contained in the core-shell type particle is 0.5 mass % or more and 10 mass % or less of the core-shell type particle.

6. The radio wave absorber according to claim 3, wherein the carbon-contained material layer is a product formed by decomposition of hydrocarbon gas.

7. The radio wave absorber according to claim 3, wherein a hydrocarbon vaporizing temperature of the carbon-contained material layer when heated in hydrogen is 300° C. or more and 650° C. or less.

8. The radio wave absorber according to claim 3, wherein the carbon-contained material layer is an organic compound.

9. The radio wave absorber according to claim 8, wherein the organic compound is an organic polymer or an organic oligomer whose main chain includes any of carbon, hydrogen, oxygen, and nitrogen.

10. The radio wave absorber according to claim 8, wherein an oxygen transmission coefficient of the carbon-contained material layer including the organic compound is greater than or equal to $1\times10^{-17}$ [$cm^3$(STP)·cm/$cm^2$·s·Pa].

11. The radio wave absorber according to claim 2, further including an oxide particle including at least one kind of the metal element selected from the second group, the metal element being included in the core portion.

12. The radio wave absorber according to claim 2, wherein the core portion has an average particle diameter of 10 nm or more and 50 nm or less.

* * * * *